US008578916B2

(12) United States Patent
Maleski et al.

(10) Patent No.: US 8,578,916 B2
(45) Date of Patent: Nov. 12, 2013

(54) CROSSBOW TRIGGER ASSEMBLY

(75) Inventors: Richard C. Maleski, Plymouth, CT (US); Carl Wilber, Morris, CT (US); Kenneth Mieczkowski, Sweet Valley, PA (US)

(73) Assignee: Archery America, L.L.C., DeQuincy, LA (US)

( * ) Notice: Subject to any disclaimer, the term of this patent is extended or adjusted under 35 U.S.C. 154(b) by 0 days.

(21) Appl. No.: 13/224,721

(22) Filed: Sep. 2, 2011

(65) Prior Publication Data

US 2012/0060808 A1 Mar. 15, 2012

Related U.S. Application Data

(63) Continuation of application No. 12/016,565, filed on Jan. 18, 2008, now Pat. No. 8,020,543.

(60) Provisional application No. 60/881,076, filed on Jan. 18, 2007.

(51) Int. Cl.
*F41B 5/12* (2006.01)

(52) U.S. Cl.
USPC ..... 124/25

(58) Field of Classification Search
USPC ..... 124/25, 35.2
See application file for complete search history.

(56) References Cited

U.S. PATENT DOCUMENTS

| | | | | |
|---|---|---|---|---|
| 3,490,429 | A | 1/1970 | Benedict | |
| 4,134,369 | A * | 1/1979 | Cook | 124/35.2 |
| 4,282,851 | A | 8/1981 | Lyons | |
| 4,479,480 | A | 10/1984 | Holt | |
| 4,716,880 | A | 1/1988 | Adkins | |
| 5,020,508 | A * | 6/1991 | Greene, Jr. | 124/35.2 |
| 5,085,200 | A | 2/1992 | Horton-Corcoran et al. | |
| 5,184,596 | A * | 2/1993 | Green et al. | 124/35.2 |
| 5,370,102 | A | 12/1994 | Peck | |
| 5,390,654 | A * | 2/1995 | Perkins | 124/24.1 |
| 5,582,158 | A | 12/1996 | Linsmeyer | |
| 6,032,661 | A | 3/2000 | Goff et al. | |
| 6,161,532 | A | 12/2000 | Goff et al. | |
| 6,205,990 | B1 | 3/2001 | Adkins | |
| 6,425,386 | B1 | 7/2002 | Adkins | |
| 6,736,123 | B1 | 5/2004 | Summers et al. | |
| 6,802,304 | B1 | 10/2004 | Chang | |
| 7,240,672 | B2 | 7/2007 | Peck et al. | |
| 7,588,022 | B2 | 9/2009 | Chang | |
| 2010/0108047 | A1 | 5/2010 | Jones | |

* cited by examiner

*Primary Examiner* — John Ricci
(74) *Attorney, Agent, or Firm* — Schultz & Associates, P.C.

(57) ABSTRACT

A crossbow trigger mechanism operable to fire an arrow or bolt. The trigger mechanism includes a trigger operatively connected to a pair of jaws for holding a tensioned crossbow string when the jaws are in a closed position. An arrow or bolt is insertable between the upper and lower jaws.

13 Claims, 21 Drawing Sheets

CROSSBOW TRIGGER ASSEMBLY

CROSSBOW TRIGGER ASSEMBLY

This application is a continuation of, and claims priority to, U.S. patent application. Ser. No. 12/016,565, filed Jan. 18, 2008 now U.S. Pat. No. 8,020,543, which claims the benefit of U.S. provisional application Ser. No. 60/881,076, filed with the U.S. Patent and Trademark Office on Jan. 18, 2007, the contents of both of which are incorporated herein by reference.

BACKGROUND OF THE INVENTION

1. Field of Invention

The present invention relates generally to crossbows, and in particular to trigger mechanisms for a crossbow.

2. Description of the Related Art

Crossbows have been used since the Middle Ages. Crossbows have evolved to include cams and synthetic split limbs that greatly increase firing velocity. However, increased firing velocity creates a problem of damage or injury when the crossbow is inadvertently fired when unloaded, i.e. when the crossbow is discharged without a bolt (also referred to as an arrow) that is loaded, i.e. pressed against the tensioned crossbow string. Unloaded or dry firing impacts can damage the crossbow string, limbs, cams and other components. Dry firing also creates a safety concern. Further, the time required to reload a dry fired crossbow will often allow quarry to escape, which is a significant concern for crossbow hunters.

In an attempt to overcome such problems, a dry fire inhibitor has been introduced in the form of a hinge lever or finger positioned along the crossbow barrel near the start of the string travel. The hinge lever is configured to normally contact the barrel, and insertion of an arrow creates a separation between the hinge lever and the barrel. When dry fired, the string will travel a short distance and then the finger will catch the string, akin to the operation of an aircraft carrier tail hook arrestor.

Conventional dry fire inhibitors fail to ensure proper loading of an arrow or bolt into the trigger mechanism and fail ensure that the arrow is properly nestled against the tensioned crossbow string. Discharge when an arrow is not properly nestled against the tensioned string can result in the string becoming lammed beneath the incorrectly loaded arrow. In addition, conventional dry fire inhibitors may ride along the arrow as the arrow is discharged, reducing crossbow accuracy.

The present invention provides an arrestor that solves the problems associated with conventional crossbow dry fire inhibitors.

The present invention further provides an impact compensator that allows for one-handed dynamic adjustment for varied target range. In contrast, conventional compensators provide a one-time setting. The impact compensator is preferably provided separate from a conventional sight.

SUMMARY OF THE INVENTION

The present invention overcomes disadvantages of conventional systems by providing a self-contained dry arrestor that includes a dry fire member and a spring which holds the dry fire member in engagement with a trigger mechanism to prevent firing the crossbow unless an arrow or bolt is loaded in the crossbow.

The present invention provides an advantage of an automatic safety feature by immobilizing the crossbow trigger when an arrow or bolt is not properly loaded.

The present invention provides a further advantage of precluding any string travel absent proper loading of an arrow.

The present invention provides yet a further advantage of avoiding misfires and jamming.

The present invention is lightweight, reliable and can be incorporated into the trigger mechanism.

The dry fire arrestor of the present invention can if desired, be combined with the above-described conventional dry fire inhibitors.

BRIEF DESCRIPTION OF THE DRAWINGS

For a better understanding of the invention as well as other objects and further features thereof, reference is made to the following detailed description to be read in conjunction with the accompanying drawings, wherein.

DETAILED DESCRIPTION OF THE PREFERRED EMBODIMENTS

Figure 1:
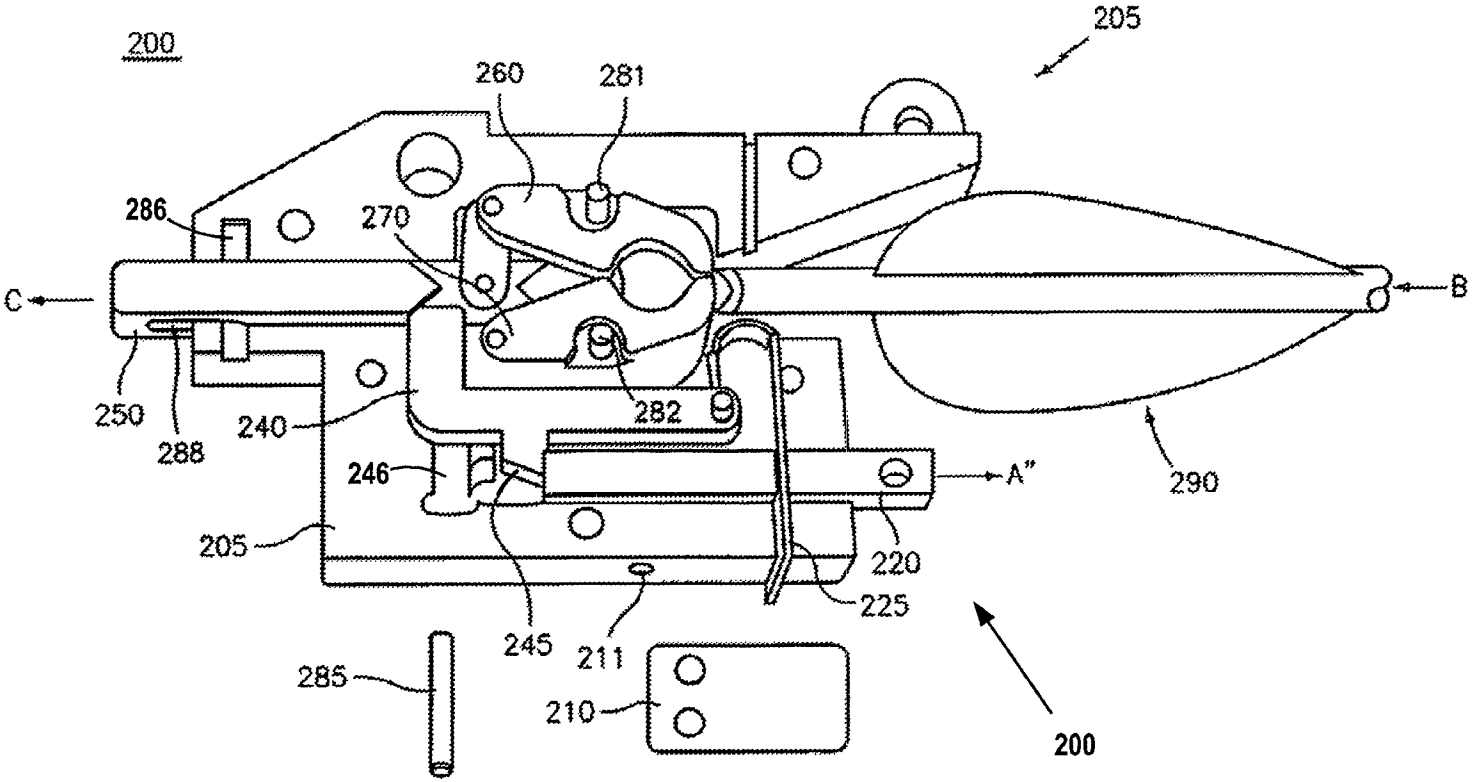
FIG. 1 is a cutaway view of the crossbow dry fire arrestor of the invention, in a cocked engagement position.

The following detailed description of the preferred embodiment of the invention will be made in reference to the accompanying drawings. In describing the invention, explanation about related functions or constructions known in the art are omitted for the sake of clarity in understanding the concept of the invention, as such would obscure the invention with unnecessary detail.

As shown in FIGS. 13-16 crossbow 100 includes stock 110, barrel 120, dry fire arrestor 200, telescopic sight 150 and sight mount 140 which secures the sight on arrestor 200. The crossbow 1.00 has limbs 160 and string 170.

Figure 8:
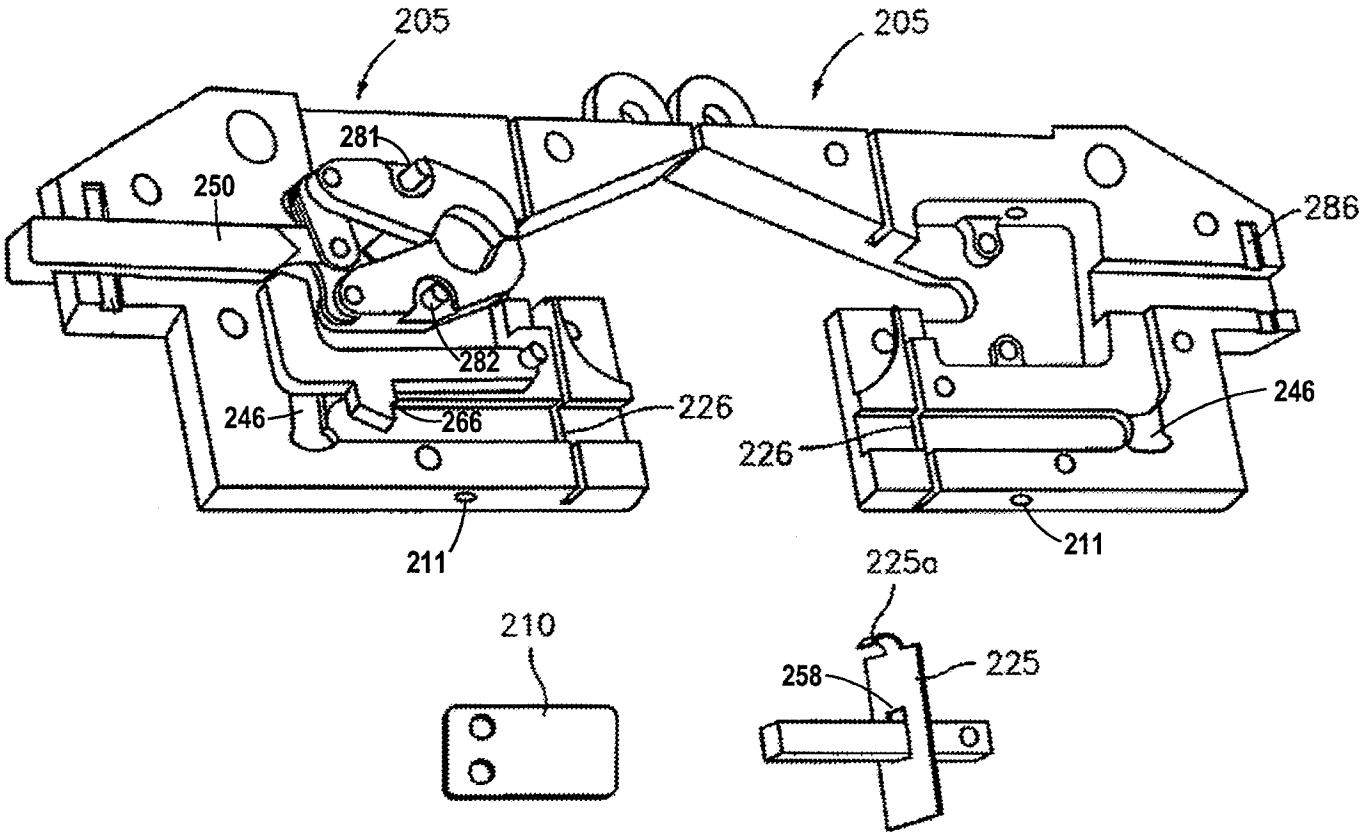
FIG. 8 is a disassembled view showing both halves of the casing of the dry fire arrestor.

FIG. 1 provides a cutaway view of the crossbow dry fire arrestor 200 in an engagement, i.e. cocked position, with a tensioned crossbow string (not shown) held between closed upper and lower jaws 260, 270 awaiting firing of the crossbow. Upper and lower jaws 260, 270 are shown in an open position in FIG. 12 and are shown in a closed (or cocked) position in FIGS. 1, 6 and 8.

Figure 9:
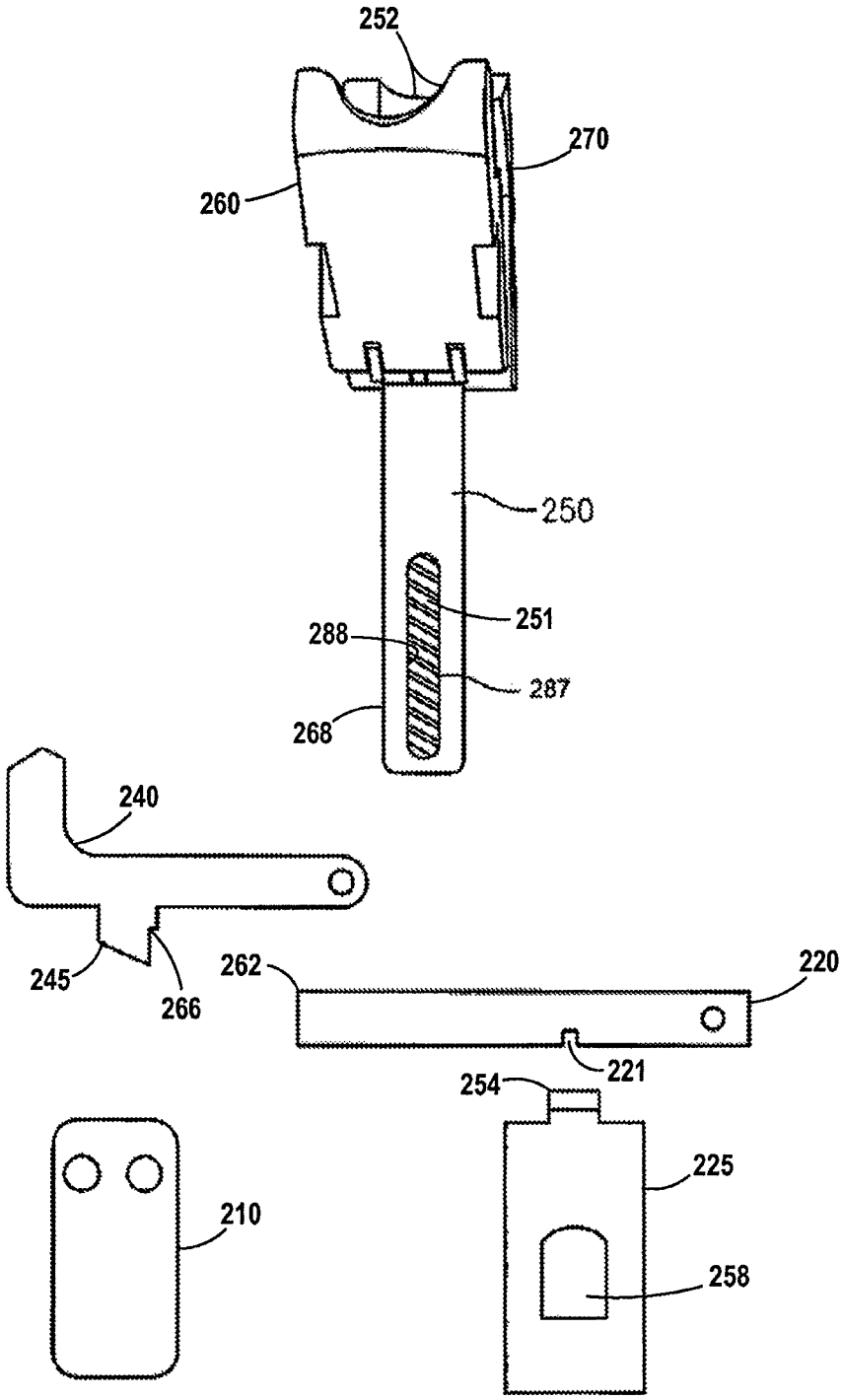
FIG. 9 is a top view of the jaws, showing a jaw urging member and jaw member slot, and other components.

Arrow 290 is shown being inserted between the jaws in direction "B" in FIG. 1. As shown in FIG. 9, an opening 252 is provided at the center of each of upper and lower jaws 260, 270 through which arrow 290 is held. It is preferable to provide both upper and lower jaws 260, 270 to hold the crossbow string at a position that is not in contact with the barrel 120 of the crossbow 100, thereby reducing string wear and improving firing accuracy. In contrast, conventional crossbow string holders utilize a single action gate that presses the string against the barrel 120.

An upper curved portion 254 of anti-dry fire bar or member 225 is preferably provided to allow for frictional contact to hold arrow 290 in the dry fire arrestor 200.

Figure 2:
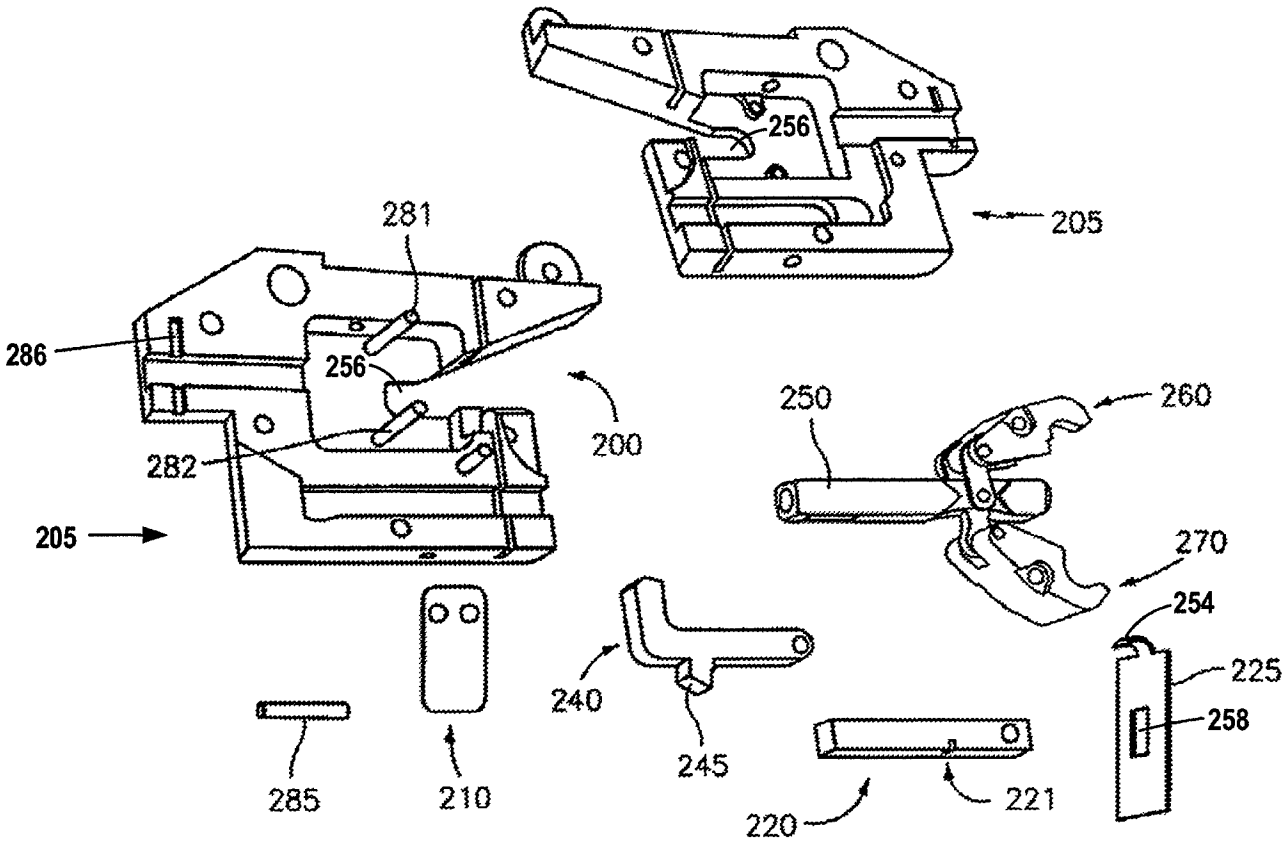
FIG. 2 is a disassembled view of the crossbow dry fire arrestor of FIG. 1.
Figure 5:
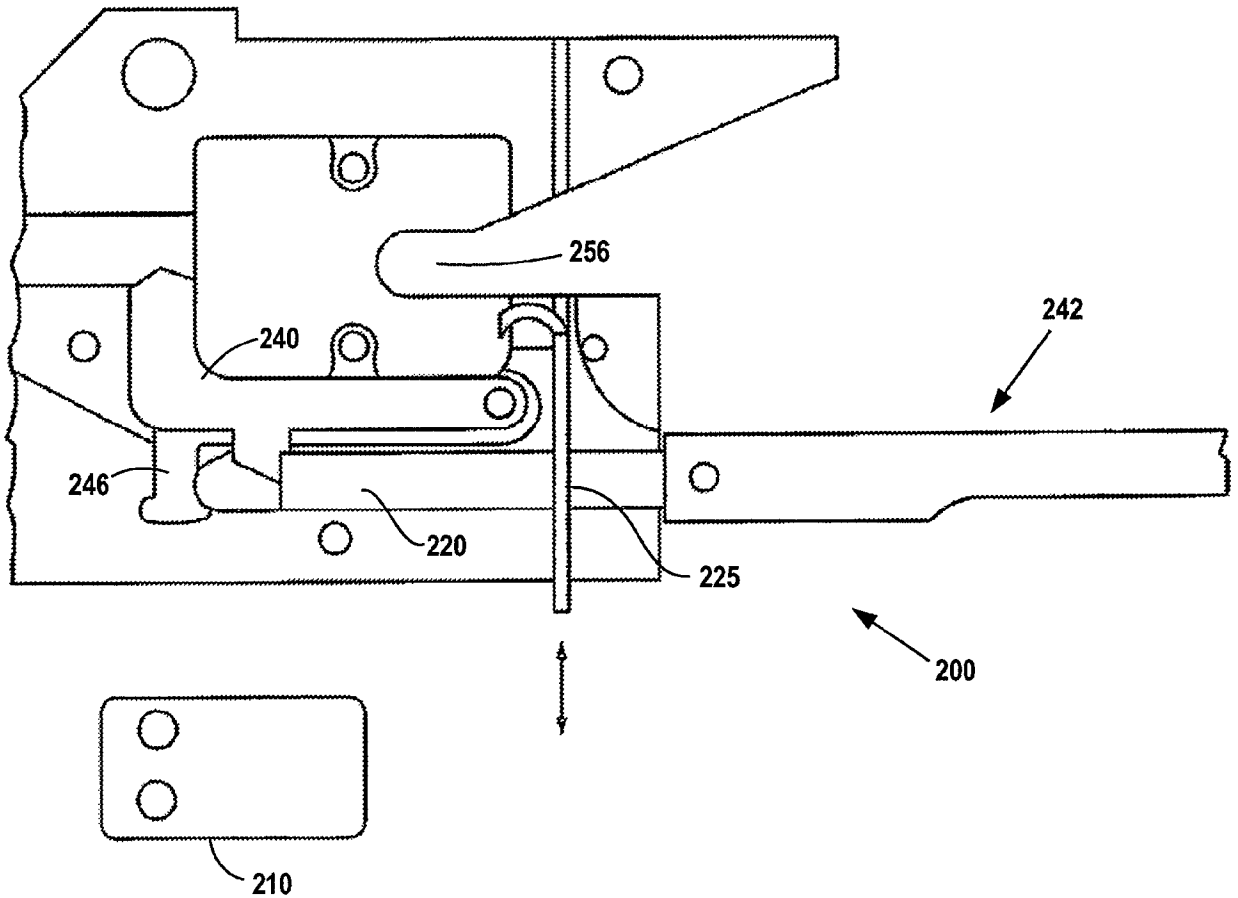
FIG. 5 is a cutaway view of the crossbow dry fire arrestor of FIG. 1, showing movement directions of an anti-dry fire bar.
Figure 7:
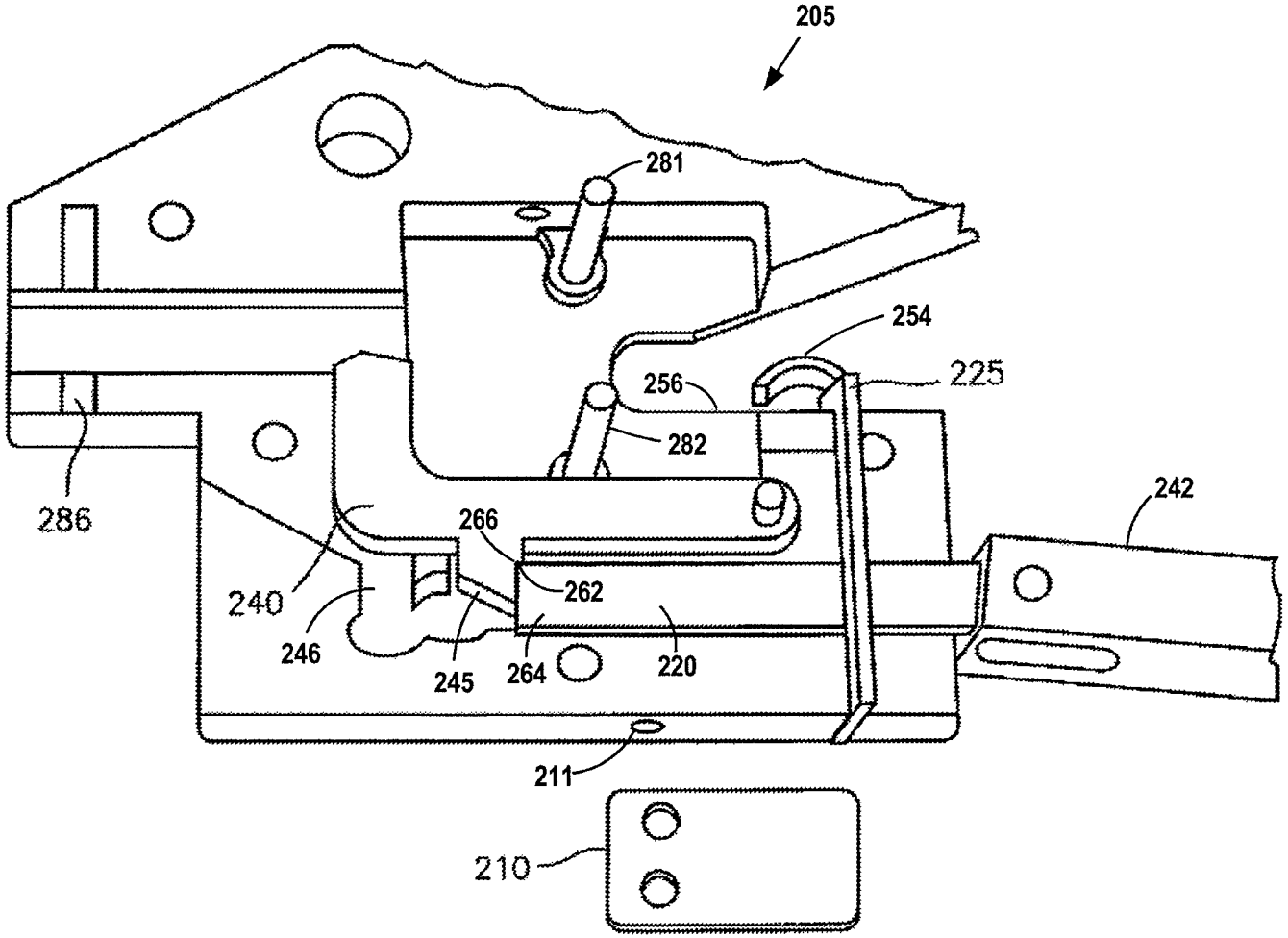
FIG. 7 is a disassembled view of the crossbow dry fire arrestor of FIG. 1, showing engagement of the trigger sear with a shoulder region of an engaging member.
Figure 19:
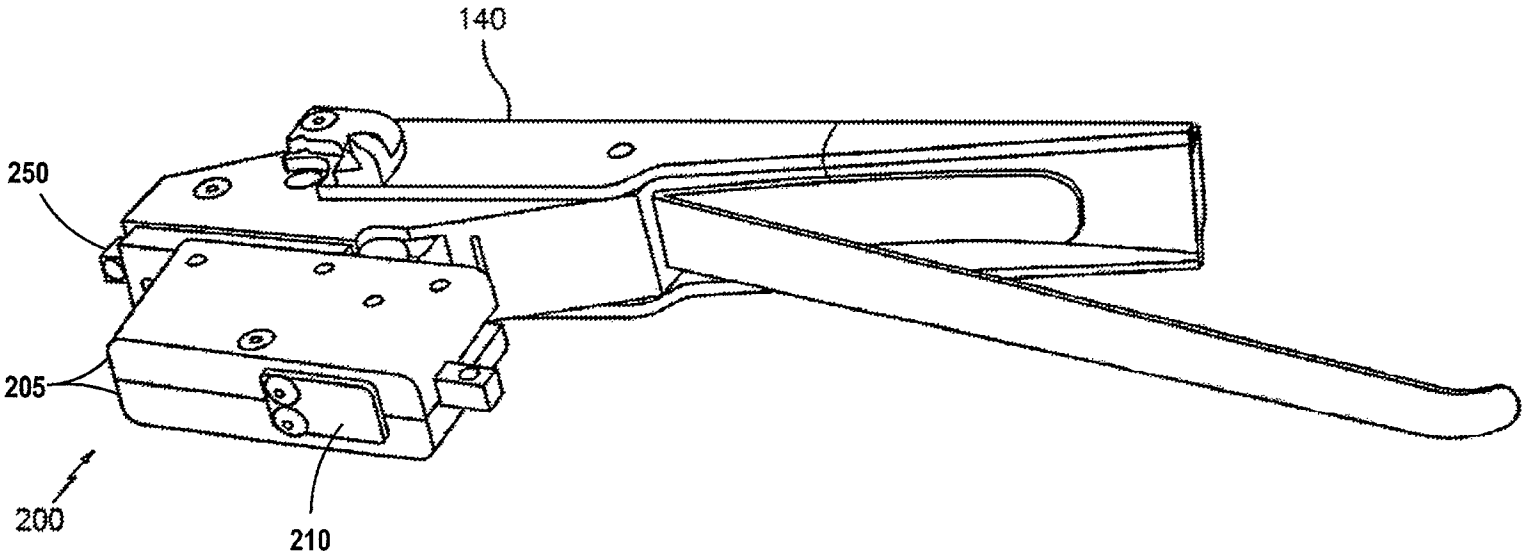
FIG. 19 is a view of dry fire arrestor and a mount for the telescopic sight.

A spring plate 210, shown disassembled from the dry fire arrestor 200 in FIGS. 1 and 2 and assembled in arrestor 200 in FIG. 19, is preferably affixed to each casing half 205 via respective affixing holes 211. The flexibility of the spring plate 210 when affixed to casing halfs 205 upwardly biases the anti-dry fire bar 225. Insertion of the arrow 290 overcomes the upward biasing force, and moves the anti-dry fire bar downward (FIG. 5). FIG. 5 shows the bar 225 in a down position below string slot 256 in casing halfs 205. FIG. 7 shows the bar in an up position with portion 254 extending into slot 256 in the casing halfs.

Figure 3:
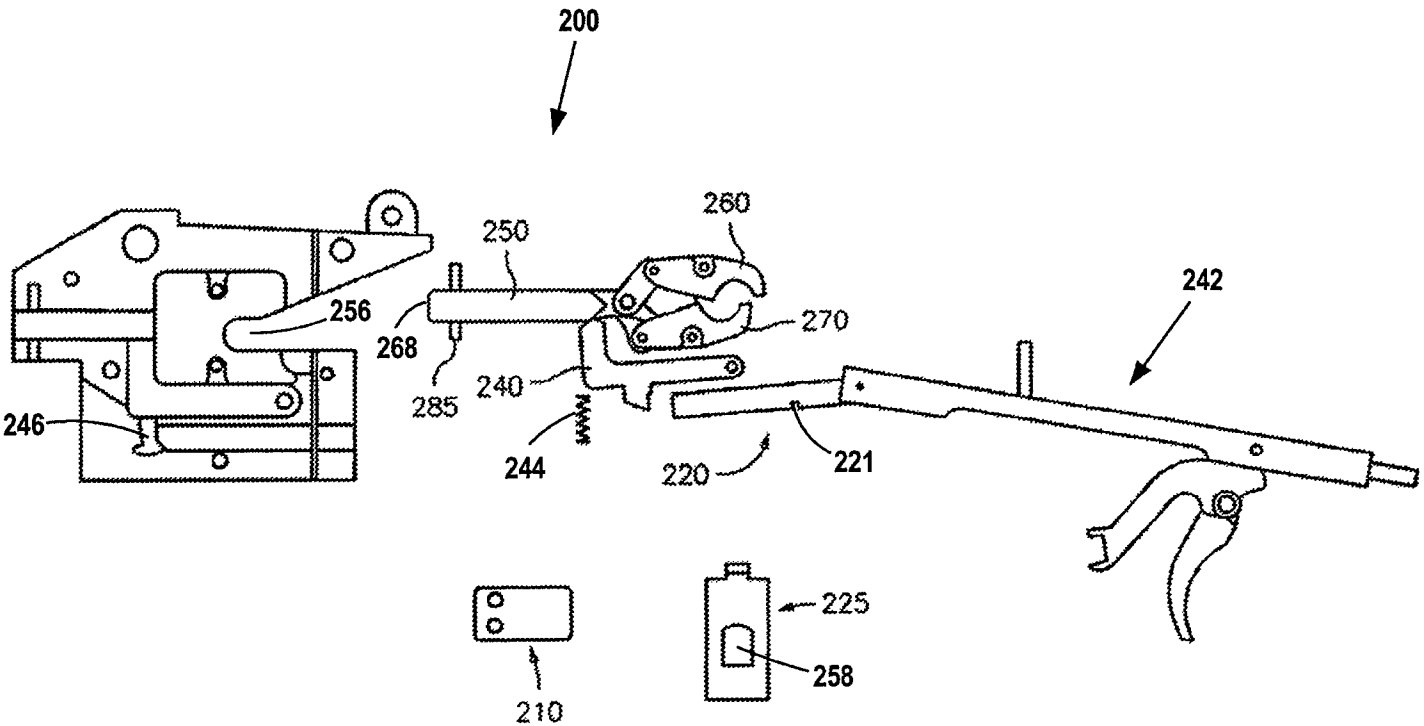
FIG. 3 is a disassembled view of the crossbow dry fire arrestor of FIG. 1, also showing a trigger mechanism.
Figure 4:
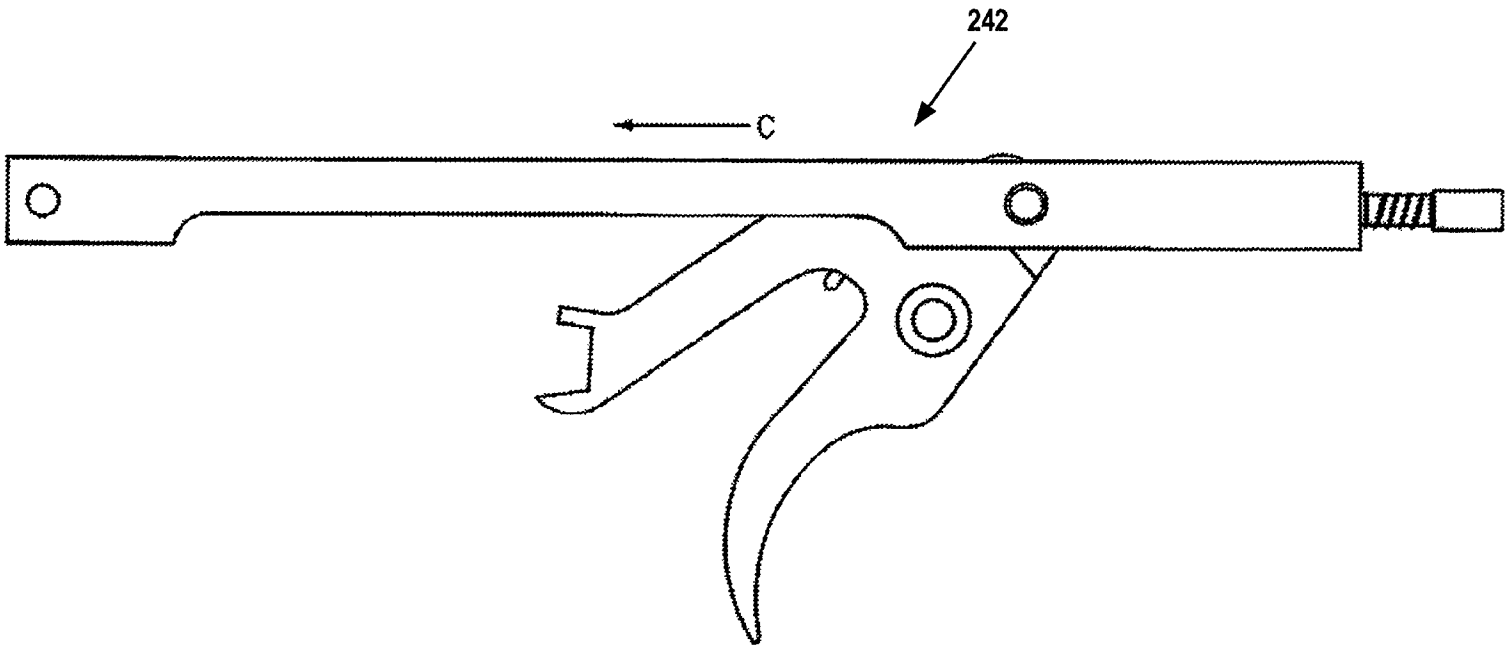
FIG. 4 is a close-up view of a portion of the trigger mechanism of FIG. 3.

FIG. 2 shows the crossbow dry fire arrestor of FIG. 1, with a trigger sear 220 and engaging member 240 further disassembled, and with crossbow string holding jaws removed. The anti-dry fire bar 225 engages and disengages with trigger sear 220, which is connected to a conventional trigger mechanism 242 as shown in FIGS. 3 and 4. The tension provided by spring plate 210 normally holds the bar 225 in the up position and allows anti-dry fire bar 225 to automatically engage trigger sear 225, which precludes any movement of the trigger when an arrow 290 is not properly inserted in the dry fire arrestor 200. The sear 220 extends through opening 258 in bar 225. When the bar is in the up position, the bottom edge of the opening is held in slot 221 in the sear to prevent movement of the sear. This automatic immobilizing of the trigger mechanism 242 acts in addition to a conventional thumb safety lock. In the present invention, pressure of the crossbow string neither activates nor precludes operation of the anti-dry fire mechanism 200.

Pulling the crossbow trigger exerts a forward motion ("A" in FIG. 1) on trigger sear 220, which abuts a shoulder region 245 of engaging member 240. As shown in FIG. 2, shoulder region 245 protrudes slightly below the otherwise flat bottom surface of jaw urging member 240.

Figure 6:
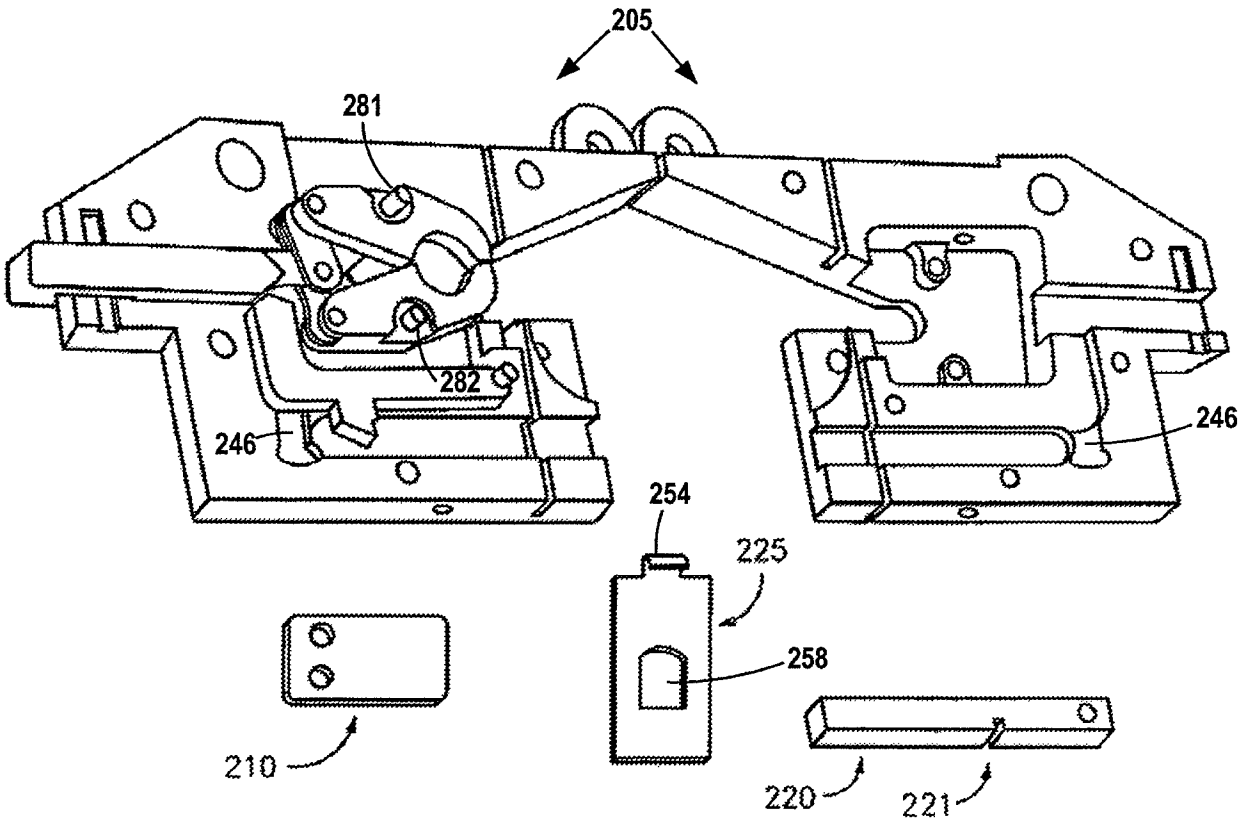
FIG. 6 is a disassembled view showing details of a slot of a trigger sear for engagement of the anti-dry fire bar.

Hole or opening 258 in the anti-dry fire bar 225 through which trigger sear 120 passes is shown in FIGS. 2 and 6. Trigger sear 220 is provided with slot 221 that engages a lower edge of the hole or opening when an arrow 290 is not properly inserted in the dry fire arrestor 200. Engagement of the anti-dry fire bar 225 with the slot 221 of trigger sear 220 precludes any movement, of the trigger sear 220. FIG. 7 provides a disassembled view of the crossbow dry fire arrestor of FIG. 1, showing engagement of the sear 220 with the shoulder region 245 of engaging member 240, with spring plate 210 removed, to allow the anti-dry fire bar 225 to protrude below the casing 205, which will allow the jaws to remain in the cocked position. In this position, the upper corner 262 of the inner end 264 of the sear 220 its in step or notch 266 in the adjacent face of region 245 on engaging or lock member 240.

Proper insertion, of the arrow pushes the anti-dry fire bar 225 downward against spring 210, thereby freeing and allowing the trigger sear 220 to move forward and move corner 262 out of engagement with step 266. Forward movement of the trigger sear 220 permits the engaging member 40 to drop, thereby allowing jaw urging member 250 (not shown in FIG. 7) to move forward, resulting in upper and lower jaws 260, 270 opening via rotation about first and second jaw fulcrum posts 281, 282.

Figure 10:
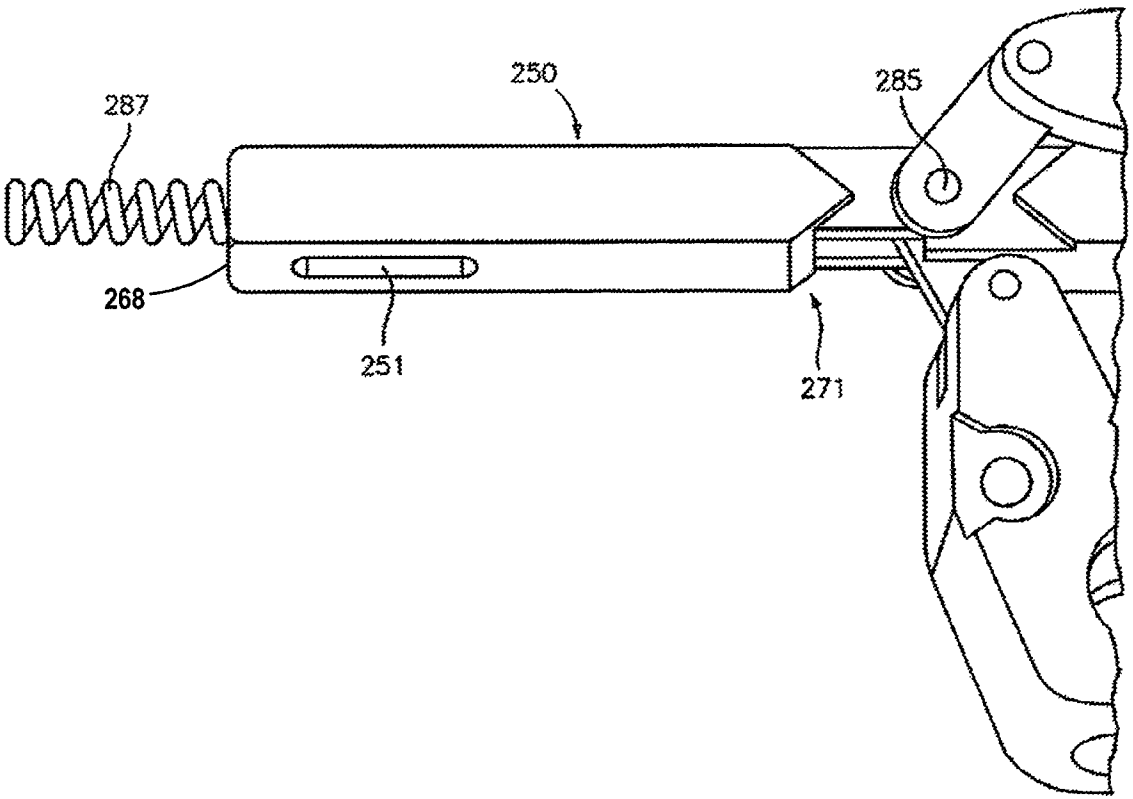
FIG. 10 is a side view of the jaw urging member.
Figure 11:
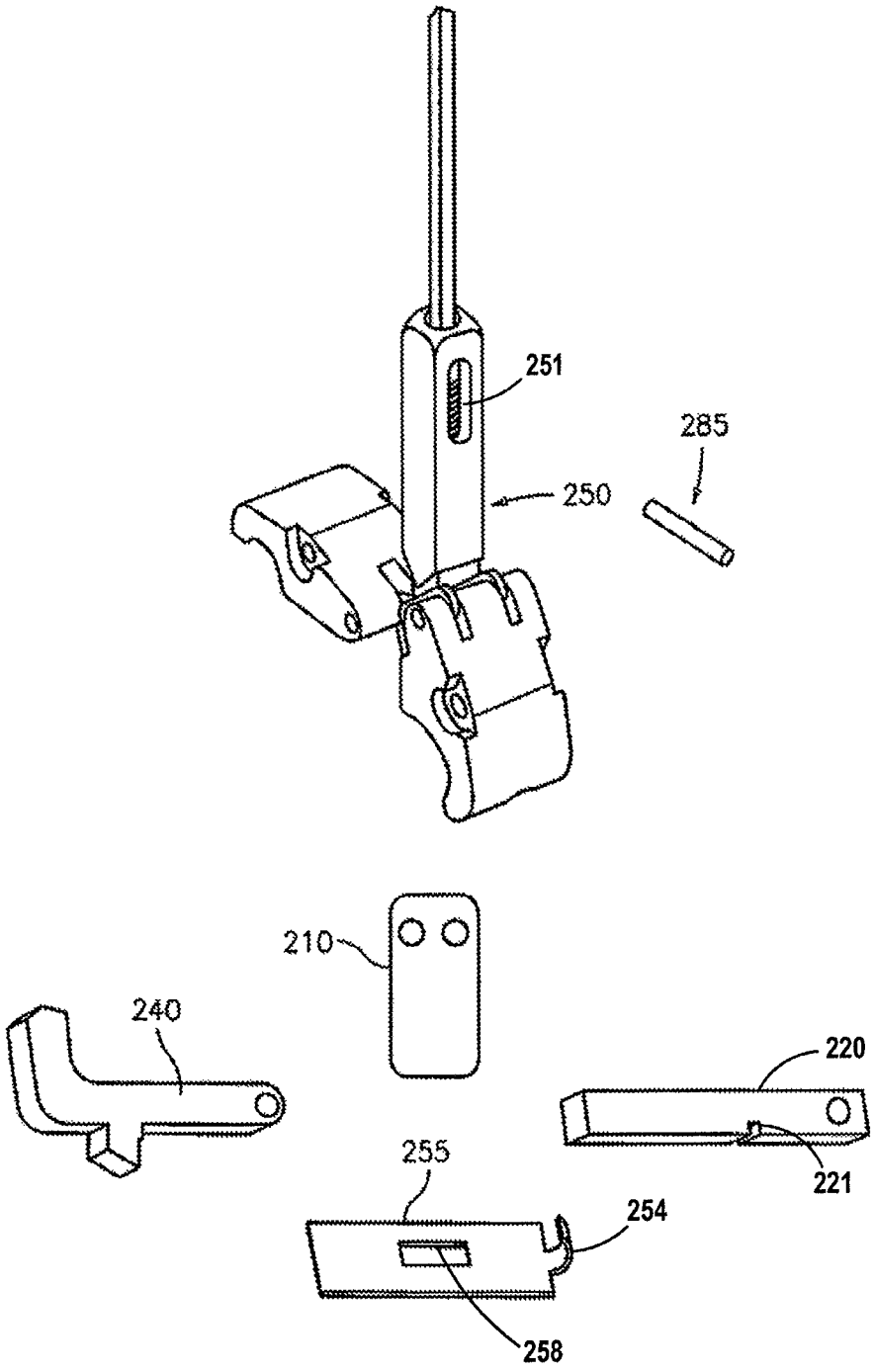
FIG. 11 shows compression of the jaw spring into its containment cavity and other components.

To provide opening/closing force for operation of the upper and lower jaws 260, 270, a jaw post 285 is provided in post groove 286 to hold jaw spring 287 in a compressed state within a containment cavity 288 in the inner end of jaw urging member 250. For clarity, FIG. 1 shows jaw post 285 removed but positioned near the post groove 286 in casing 205. FIG. 9 provides a top view of the jaws, showing jaw urging member 250 and containment, cavity 288. Access to the containment, cavity 288 is provided via a jaw member slot 251 shown in FIGS. 9 and 10, through which the jaw post 285 passes (see FIG. 3), and via a distal or inner end 268 (FIGS. 2 and 11) of jaw urging member 250. FIG. 10 provides a side view of the jaw urging member 250, showing jaw spring 287 protruding from its containment cavity via the distal end of jaw urging member 250, and FIG. 11 shows compression of the jaw spring 287 into its containment cavity for insertion of jaw post 285 through jaw member slot 251.

Figure 12:
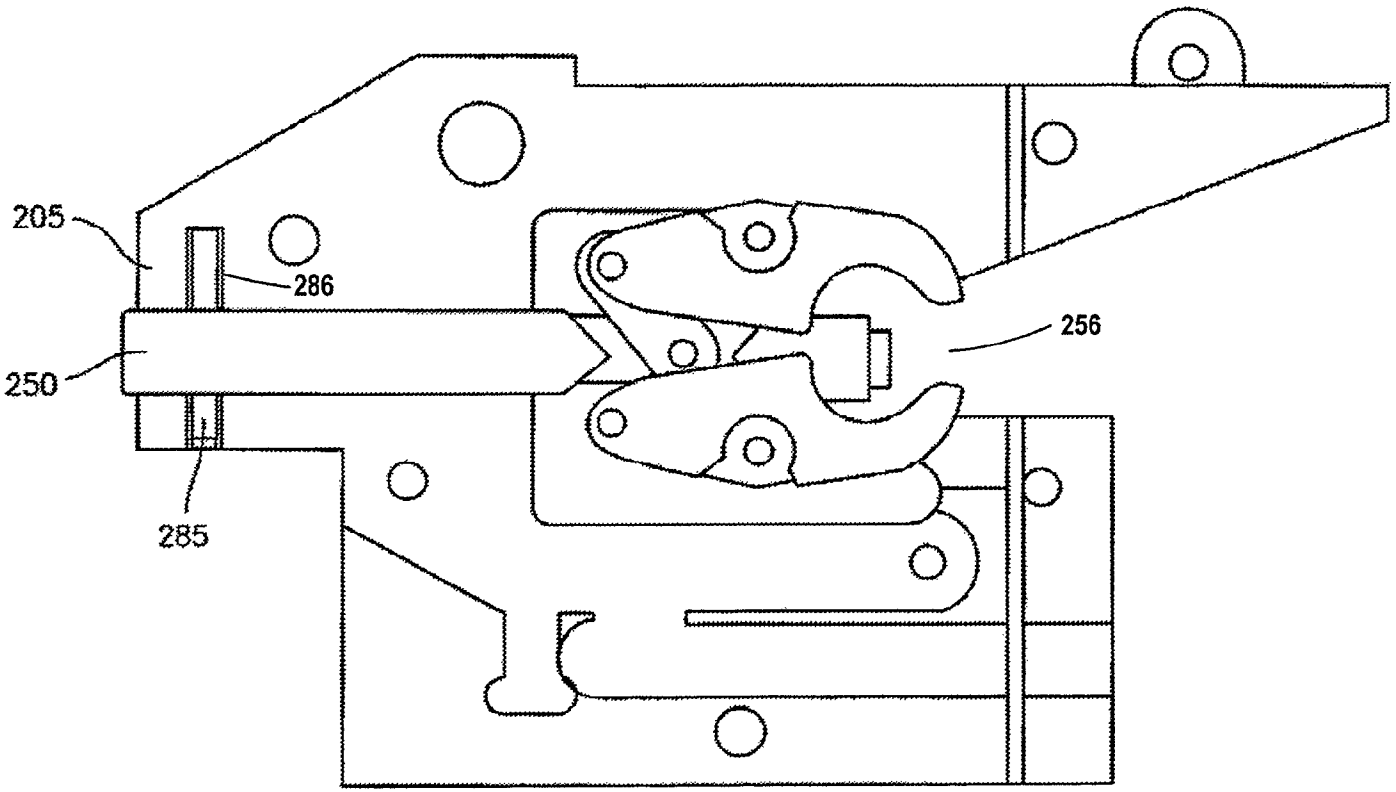
FIG. 12 shows a partially assembled dry fire arrestor.

As shown in FIGS. 8-12, compression of jaw spring 287 in containment cavity 288 creates a tension force against jaw pin 285. FIG. 12 depicts the normally open position of upper and lower jaws 260, 270, awaiting insertion of the crossbow string, which pushes forward edges of the upper and lower jaws apart, creating a rotation force about first and second jaw fulcrum pins 281 and 282 (FIGS. 1 and 7) and pushing the jaw urging member 250 in a rearward direction (arrow "C" of FIG. 1). The jaw spring 287 force opposes such rearward pushing of jaw urging member 250. Rearward movement of member 250 closes jaws 260 and 270 on the crossbow string and moves the member to the position of FIG. 1. Spring 244 is fitted in recess 246 and holds member 240 in the position of FIG. 1 for engagement with sear 220. The sear holds member 250 against release until an arrow is loaded in the crossbow to move bar 225 down and out, of slot 221 and free the sear for movement when the trigger is pulled.

Figure 13:
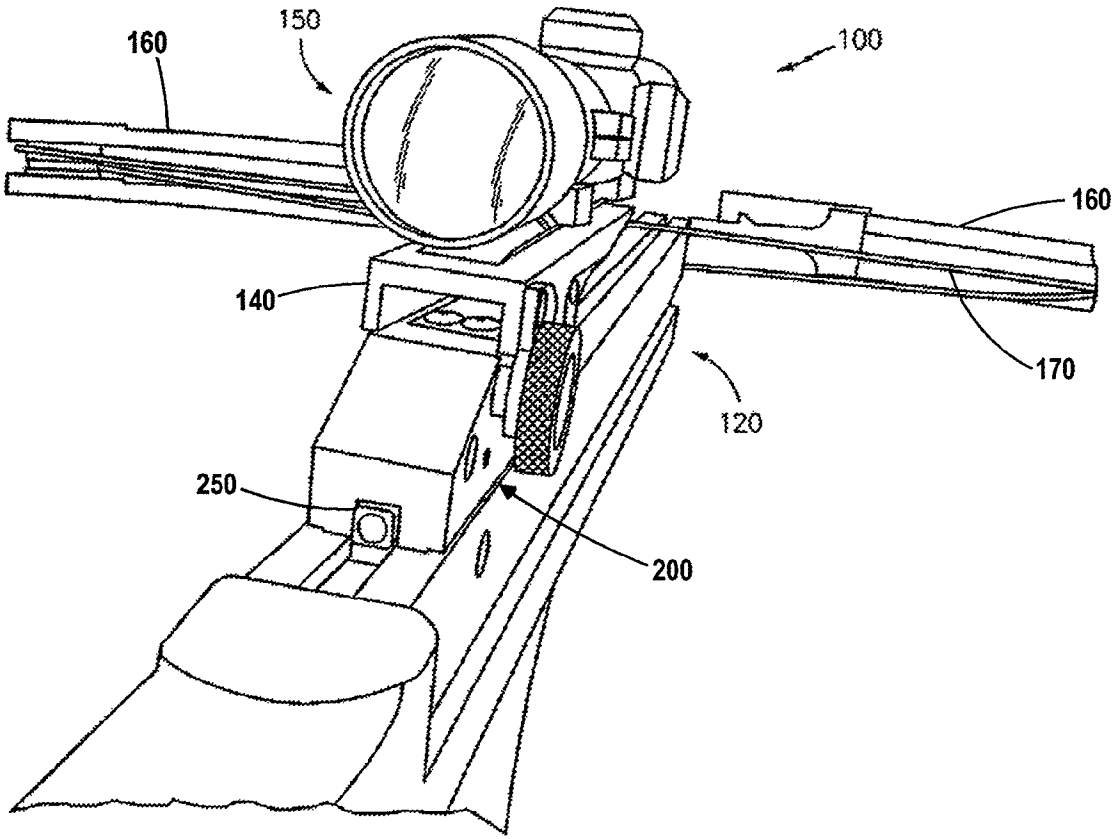
FIG. 13 is a perspective view of a crossbow with a dry fire arrestor and a telescopic sight.
Figure 14:
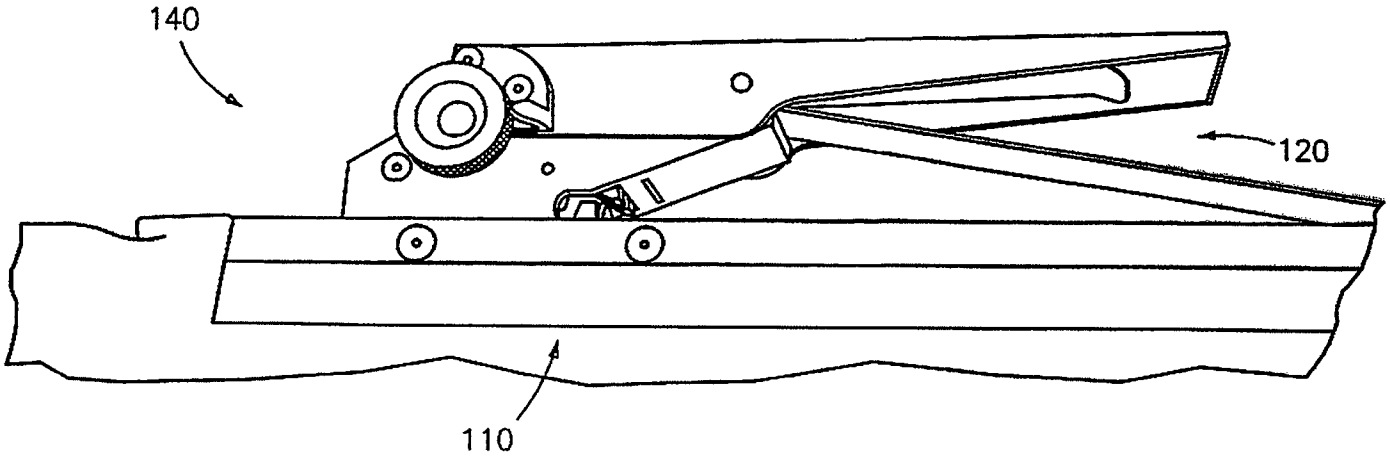
FIG. 14 shows the impact compensator mounted onto stock.
Figure 15:
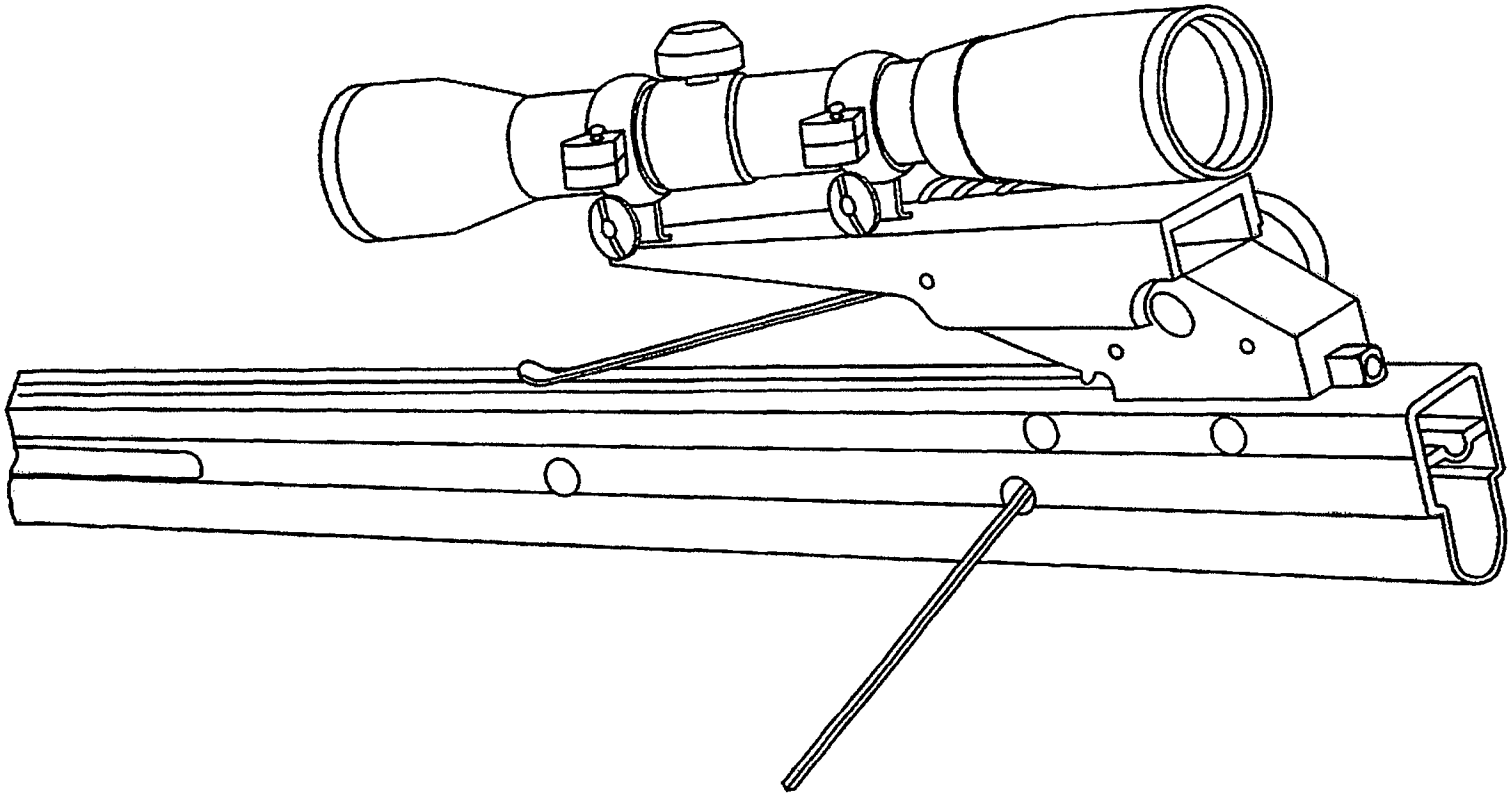
FIG. 15 shows the impact compensator being removed from the stock.
Figure 17:
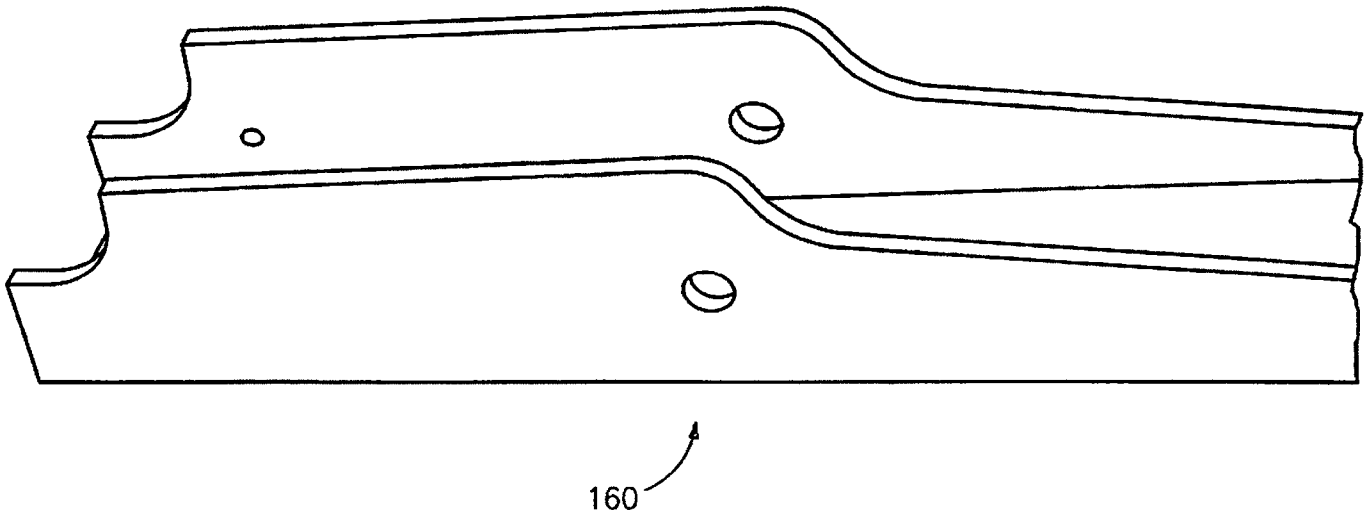
FIG. 17 shows the pivoting sight rail removed from the impact compensator.

FIG. 13 provides a perspective view of the crossbow, looking through a sight 150 of impact compensator 120. As shown in FIG. 14, the impact compensator 120 is mounted onto stock 110. The sight 150 removed in FIG. 14, and FIG. 15 shows the impact compensator 120 being removed from the stock 110. FIG. 17 shows pivoting sight rail 160 removed from the impact compensator 120. When assembled, a spring force holds the pivoting sight rail 160 close to the main body 121 of the impact compensator.

Figure 16:
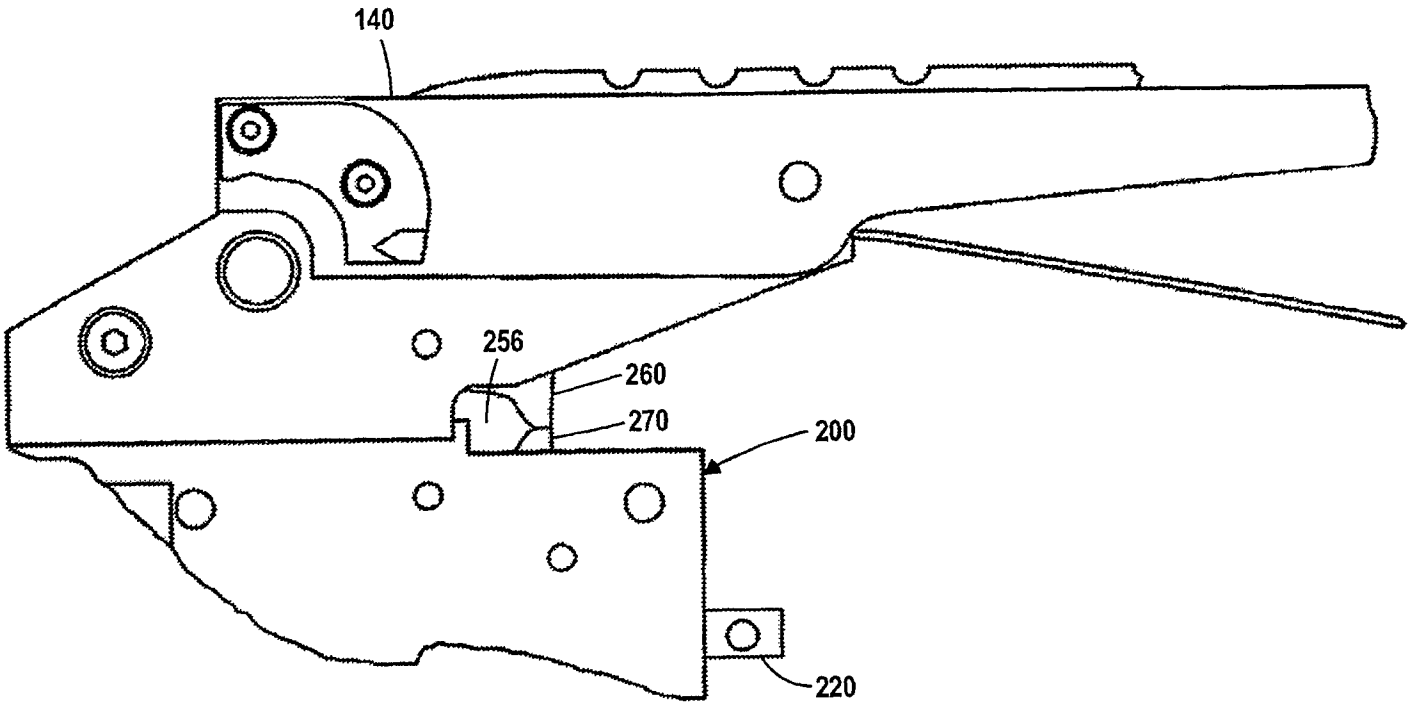
FIG. 16 is a side view of the crossbow with a telescopic sight, partially broken away.
Figure 18:
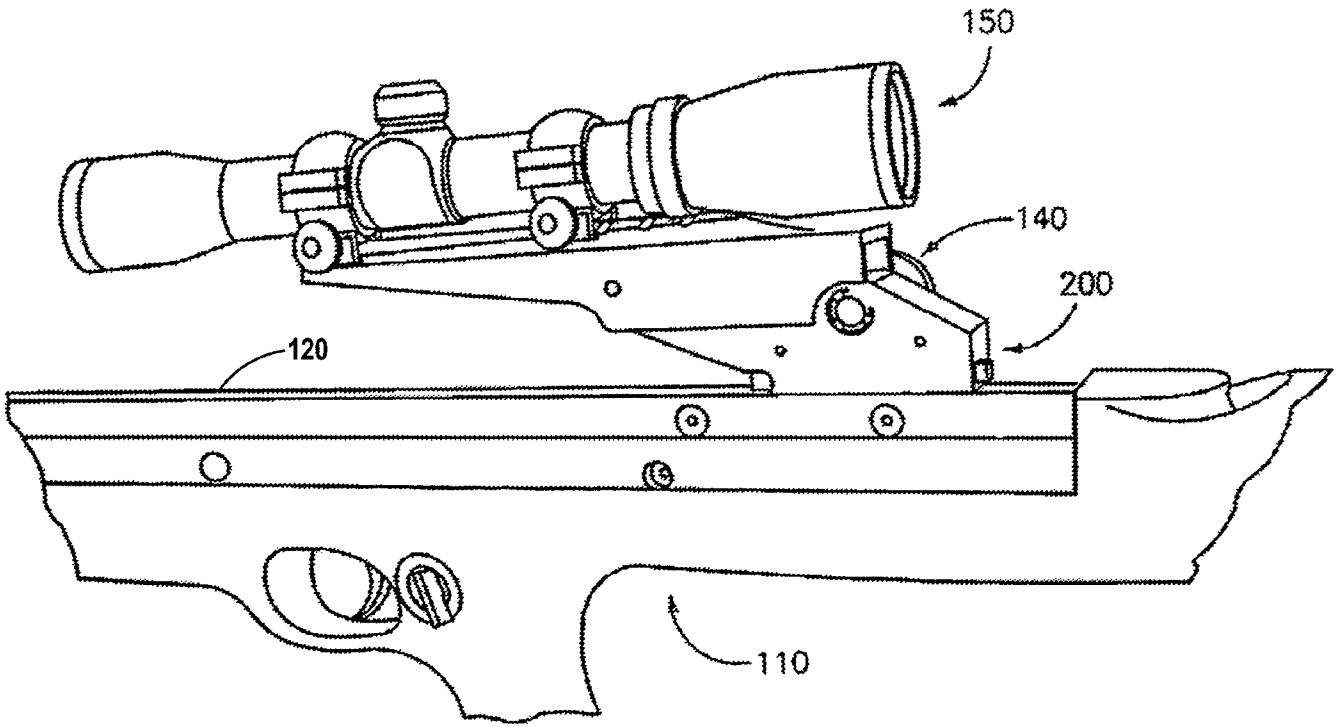
FIG. 18 is a side view of the crossbow taken from the side opposite the side shown in FIG. 14.

As shown in FIG. 16, sight rail 160 pivots about an impact compensator pivot 135, in a rotational direction indicated by arrow (FIG. 18). A compensator adjusting wheel 140 is provided to allow the user to adjust the extent of rotational movement of pivoting sight rail 160 while viewing a target through the sight 150. A retaining ring 149 (FIG. 18) is provided to rotatably hold a pin 145 of the compensator adjusting wheel 140 within a hole 146 (FIG. 20) of the impact compensator 120.

Figure 20:
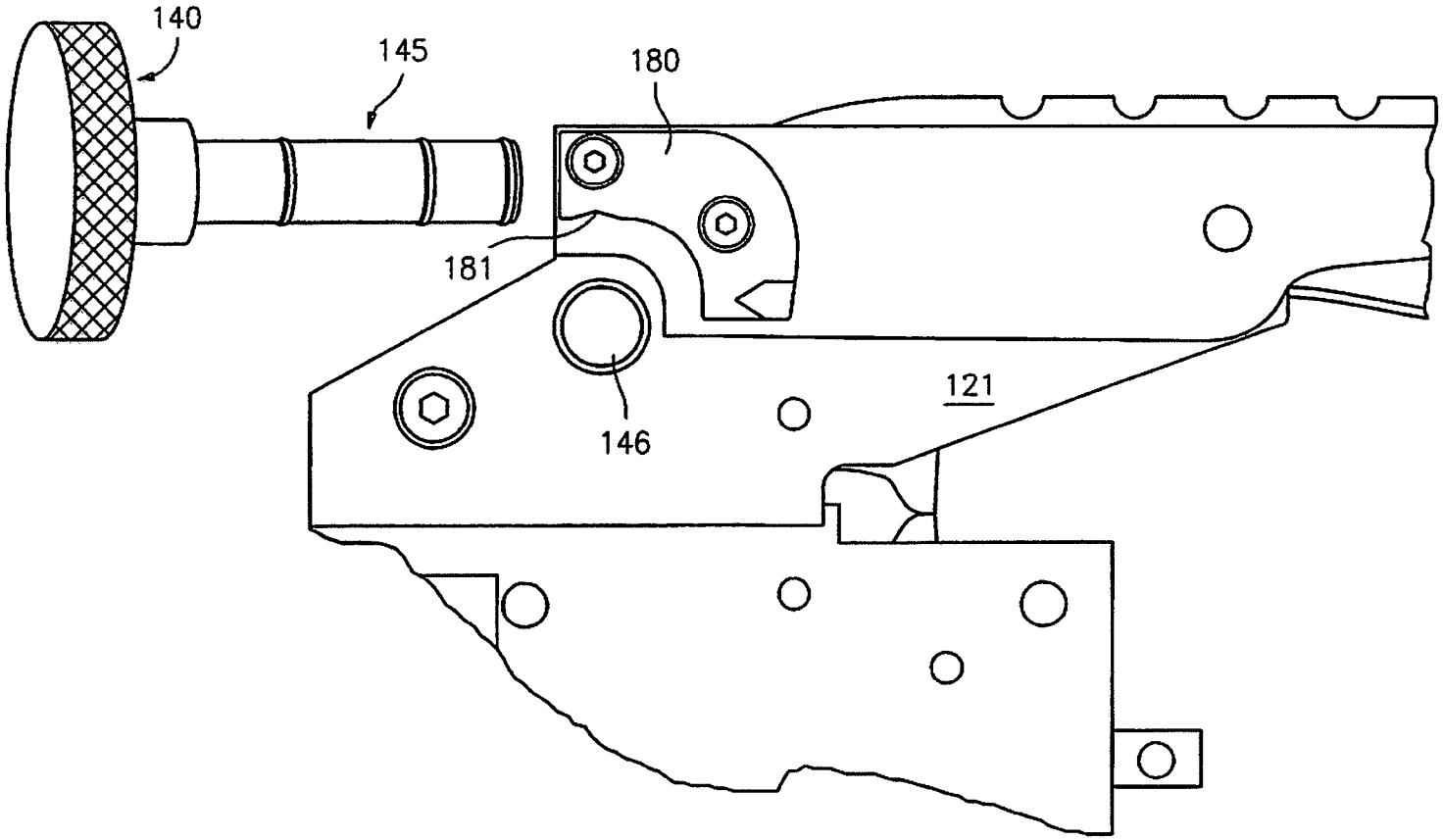
FIG. 20 is a perspective view of impact compensator with the compensator wheel removed.
Figure 21:
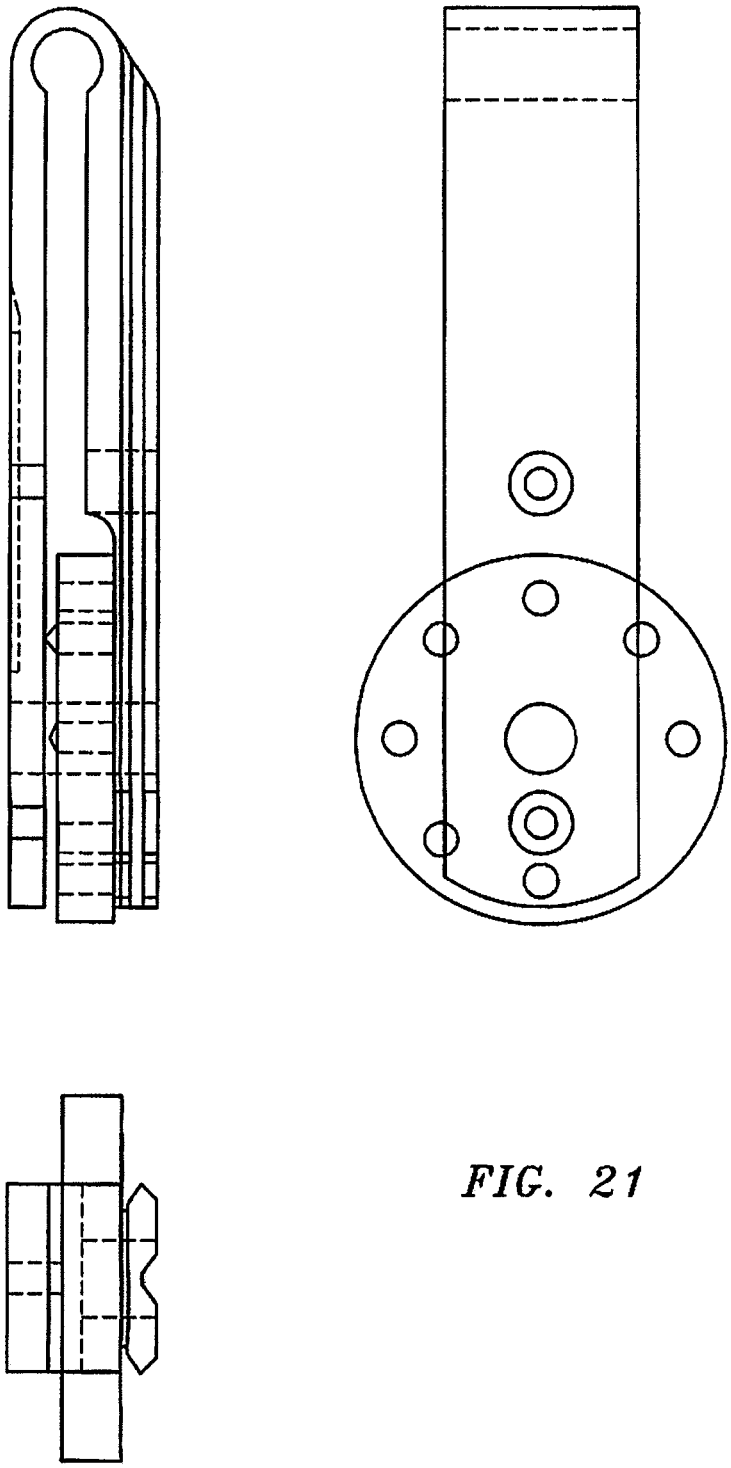
FIG. 21 is a perspective view of a horizontal impact compensator.

Elevational protrusions 140*a* through 140*f* of the compensator adjusting wheel 140 sequentially push against an elevation cam 180 affixed to the pivoting sight rail 160. The elevational protrusions 140*a* through 140*f* are of varying height, and a notch 181 is provided in the elevation cam 180 to retain one selected elevational protrusion 140*a* through 1401 and provide the user with a click through adjustment. FIG. 20 provides a perspective view of impact compensator 120 with the compensator wheel 140 removed, showing elevational protrusions 140*a* through 140*f* spaced at regular interval around a circumference of: the compensator wheel for contacting a shoulder region of elevation cam 180, to incrementally raise the height of the pivoting sight rail 160 as a user turns compensator wheel 140.

As shown in FIG. 18, sight 150 is attached to the impact compensator rail 160, and the pivoting movement about impact compensator pivot 125 via adjustment of compensator wheel 140 will adjust the range of the sight 150. As shown in FIG. 14, range marking are preferably provided on compensator wheel 140. It is also preferred that an outer circumference of compensator wheel 140 be abraded or knurled to enhance friction and sensitivity.

What is claimed is:

1. A crossbow trigger mechanism operable to fire an arrow or bolt comprising upper and lower jaws operatively connected to a trigger, the upper and lower jaws for holding a tensioned crossbow string when the jaws are in a closed position, wherein an opening is provided between the upper and lower jaws through which the arrow or bolt is inserted, and an arrow or bolt inserted between the upper and lower jaws.

2. The crossbow trigger mechanism of claim 1, wherein the upper and lower jaws hold the crossbow string at a position not contacting a barrel of the crossbow.

3. The crossbow trigger mechanism of claim 1, wherein actuation of the trigger causes the upper and lower jaws to move from the closed position to an open position, thereby releasing the tensioned crossbow string and firing the arrow or bolt.

4. The crossbow trigger mechanism of claim 3, wherein the upper and lower jaws are rotatably mounted on first and second fulcrum pins, and actuation of the trigger causes the upper and lower jaws to rotate about the first and second fulcrum pins from the closed position to the open position.

5. The crossbow trigger mechanism of claim 1, further comprising a dry fire arrestor comprising:

a trigger sear;

a shiftable anti-dry fire member for engaging and disengaging the trigger sear to prevent and allow trigger operation;

a spring biasing the anti-dry fire member to engage the trigger sear and prevent trigger operation;

the anti-dry fire member including a portion contacted by the arrow or bolt when inserted into the crossbow to shift the anti-dry fire member out of engagement with the trigger sear;

wherein insertion of the arrow or bolt into the crossbow to engage the string shifts the anti-dry fire member, disengages the anti-dry fire member from the trigger sear and allows trigger operation.

6. A crossbow comprising a trigger mechanism operable to fire an arrow or bolt, the trigger mechanism including a trigger operatively connected to a pair of jaws for holding a tensioned crossbow string, said jaws defining an opening for receiving a portion of the arrow or a bolt.

7. The crossbow as in claim 6 wherein the upper and lower jaws hold the crossbow string at a position not contacting a barrel of the crossbow.

8. The crossbow of claim 6, further comprising a dry fire arrestor comprising:

a trigger sear;

a shiftable anti-dry fire member for engaging and disengaging the trigger sear to prevent and allow trigger operation;

a spring biasing the anti-dry fire member to engage the trigger sear and prevent trigger operation;

the anti-dry fire member including a portion contacted by the arrow or bolt when inserted into the crossbow to shift the anti-dry fire member out of engagement with the trigger sear;

wherein insertion of the arrow or bolt into the crossbow to engage the string shifts the anti-dry fire member, disengages the anti-dry fire member from the trigger sear and allows trigger operation.

9. A crossbow trigger mechanism operable to fire an arrow or bolt comprising a trigger operatively connected to upper and lower jaws for holding a tensioned crossbow string when the jaws are in a closed position, wherein an opening is provided between the jaws through which an arrow or bolt may be inserted.

10. The crossbow trigger mechanism of claim 9, wherein the upper and lower jaws hold the crossbow string at a position not contacting a barrel of the crossbow.

11. The crossbow trigger mechanism of claim 9, wherein actuation of the trigger causes the jaws to move from the closed position to an open position, thereby releasing the tensioned crossbow string.

12. The crossbow trigger mechanism of claim 11, wherein the jaws are rotatably mounted on first and second fulcrum pins, and actuation of the trigger causes the jaws to rotate about the first and second fulcrum pins from the closed position to the open position.

13. The crossbow trigger mechanism of claim 9, further comprising a dry fire arrestor comprising:

a trigger sear;

a shiftable anti-dry fire member for engaging and disengaging the trigger sear to prevent and allow trigger operation;

a spring biasing the anti-dry fire member to engage the trigger sear and prevent trigger operation;

the anti-dry fire member including a portion contacted by the arrow or bolt when inserted into the crossbow to shift the anti-dry fire member out of engagement with the trigger sear;

wherein insertion of the arrow or bolt into the crossbow to engage the string shifts the anti-dry fire member, disengages the anti-dry fire member from the trigger sear and allows trigger operation.

* * * * *